United States Patent [19]

Hurst

[11] 4,214,470

[45] Jul. 29, 1980

[54] METHOD AND APPARATUS FOR COOLING DRAWN WIRE

[75] Inventor: Michael J. Hurst, Southampton, England

[73] Assignee: Hi-Draw Machinery Ltd., Romsey Hampshire, England

[21] Appl. No.: 868,913

[22] Filed: Jan. 12, 1978

[30] Foreign Application Priority Data

Jan. 14, 1977 [GB] United Kingdom ..... 1578/77
Mar. 28, 1977 [GB] United Kingdom ..... 12952/77

[51] Int. Cl.[3] ..... B21C 9/00
[52] U.S. Cl. ..... 72/286
[58] Field of Search ..... 72/286, 44, 45

[56] References Cited

U.S. PATENT DOCUMENTS

| | | | |
|---|---|---|---|
| 2,226,016 | 12/1940 | Pierce | 72/286 |
| 3,064,798 | 11/1962 | Nye et al. | 72/286 |
| 3,789,641 | 2/1974 | Miller et al. | 72/45 |
| 3,850,016 | 11/1974 | Stofey et al. | 72/45 |

*Primary Examiner*—Milton S. Mehr
*Attorney, Agent, or Firm*—Daniel Patch; Suzanne Kikel

[57] ABSTRACT

A method and apparatus for cooling elongate material, such as wire, after it has been drawn through a die, in which liquid coolant is applied to the drawn elongate material in only sufficient quantity to enable all or substantially all of the applied liquid coolant to be evaporated thus utilizing the latent heat of evaporation of the liquid coolant to cool the elongate material.

5 Claims, 8 Drawing Figures

METHOD AND APPARATUS FOR COOLING DRAWN WIRE

BACKGROUND OF THE INVENTION

This invention relates to a method and apparatus for effecting cooling of elongate material after it has been drawn through a drawing die of drawing apparatus.

In the process of drawing elongate material such as wire, the material upon being drawn through the die or dies has its temperature substantially increased and the drawn materials has to be cooled. The known methods of cooling the material can restrict the speed and production rate of drawing machines. This problem is most severe on multi-die drawing machines where the material is successively drawn through two or more dies and the material can have its temperature increased to a value at which the properties of the material are adversely affected.

It is known to pass the drawn material through a trough or tube containing water but this substantially increases the overall length of the drawing machine which makes threading of the material through the machine difficult. Large quantities of water have to be provided.

It is also known to water cool the inside surface of the capstan of the drawing apparatus which draws the material through the die or dies. A disadvantage of this known cooling system is that heat from the elongate material wound on the capstan has to be conducted through the capstan to the water. The line contact of the drawn material with the capstan, the thickness of the wall of the capstan and the boundary layer of the water form resistances to heat flow and therefore the cooling system is not efficient.

It is also known to spray quantities of water onto the drawn material downstream of the or each die but this method utilizes large quantities of water, with the inherent disadvantage of having to handle large quantities of water. With the trough or tube method and the known spraying method the water which is used to effect cooling is only heated to a temperature below its evaporation point and it is necessary to wipe excess water from the drawn material before it enters the next die.

SUMMARY OF THE INVENTION

This invention relates as aforesaid to a method and apparatus for effecting cooling of elongate material after it has been drawn through a drawing die of drawing apparatus, more particularly, but not exclusively, to a method and apparatus for cooling drawn wire.

An object of the present invention is to provide a cooling system in which substantially all of the liquid coolant applied to the hot drawn wire is evaporated thus avoiding the need for wiping means.

Another object of the present invention is to provide a cooling system which does not increase the overall length of the drawing machine.

Yet another object of the present invention is to provide a cooling system which does not require large quantities of liquid coolant.

According to the present invention in one aspect, there is provided a method of cooling elongate material after it has been drawn through a die, comprising applying to the drawn elongate material liquid coolant in only sufficient quantity to enable all or substantially all of the applied liquid coolant to be evaporated and utilizing the latent heat of evaporation of the liquid coolant to cool the elongate material.

The liquid coolant may be applied to the elongate material in the region between the die and the capstan or to the turns of elongate material wound on the capstan.

In one embodiment of the method the liquid coolant is applied to the lowermost turns of elongate material on the capstan and conveyed axially along the capstan with the turns.

The liquid coolant is preferably sprayed onto the elongate material from a plurality of atomiser spray nozzles or a duplex atomiser spray nozzle, each flow being separately controlled.

The liquid may be sprayed directly onto the elongate material or onto a roller in contact with the elongate material.

In another embodiment of the method the liquid coolant is supplied to the inside of the capstan and flows through at least one aperture in the capstan to the helical space formed between the external surface of the capstan and two adjacent turns of elongate material wound on the capstan, the evaporate being exhausted from the helical space. Preferably the evaporate is exhausted into the interior of the capstan through at least one further aperture in the capstan.

The liquid coolant is preferably water but it may comprise any suitable liquid.

According to the present invention in another aspect there is provided apparatus for cooling elongate material after it has been drawn through a die, comprising spray means located downstream of the die for spraying liquid coolant onto the elongate material and means for controlling the quantity of coolant sprayed by the spray means so that all or substantially all of the sprayed liquid coolant applied to the elongate material is evaporated and the latent heat of evaporation of the liquid coolant serves to cool the elongate material.

The spray means may be arranged to direct its spray onto the elongate material in the region between the die and the capstan or onto the turns of elongate material wound on the capstan. Alternatively the spray means may be arranged to direct its spray onto a roller which applies the liquid coolant onto the elongate material.

According to the present invention in yet another aspect there is provided apparatus for cooling elongate material after it has been drawn through a die, comprising a capstan, means for supplying liquid coolant to the inside of the capstan, at least one aperture in the capstan through which liquid coolant can flow so as to be received in the helical space between the external surface of the capstan and two adjacent turns of elongate material when wound on the capstan.

Preferably the capstan is provided with at least one further aperture through which evaporate can flow into the interior of the capstan.

The capstan may be provided on its inside with an annular trough for receiving liquid coolant from said supply means, said at least one aperture communicating with the interior of said trough.

Preferably the spray means comprises a plurality of atomiser spray nozzles or a duplex atomiser spray nozzle and control means for separately controlling the flow to each nozzle.

In one embodiment the apparatus comprises a storage tank for liquid coolant, a pump for pumping liquid from the storage tank, a solenoid operated valve for controlling the flow of liquid from said pump to a manifold, a timer for controlling operation of said solenoid operated valve, a first atomiser spray nozzle for receiving liquid coolant from the manifold, a second atomiser spray nozzle, a second solenoid operated valve for controlling the flow of liquid from said manifold to said second spray nozzle and a second timer for controlling operation of said second solenoid operated valve.

With the method according to the present invention the elongate material is cooled by utilizing the latent heat of evaporation of the liquid coolant and therefore all or substantially all of the liquid coolant applied to the elongate material is removed by being evaporated and preferably there is no need to provide wiping means for wiping liquid coolant from the cooled elongate material. The quantity of liquid coolant which is used is considerably less than that required with the known methods when only the sensible heat of the liquid is utilized to effect cooling.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings.

DESCRIPTION OF THE PREFERRED EMBODIMENTS

Figure 1:
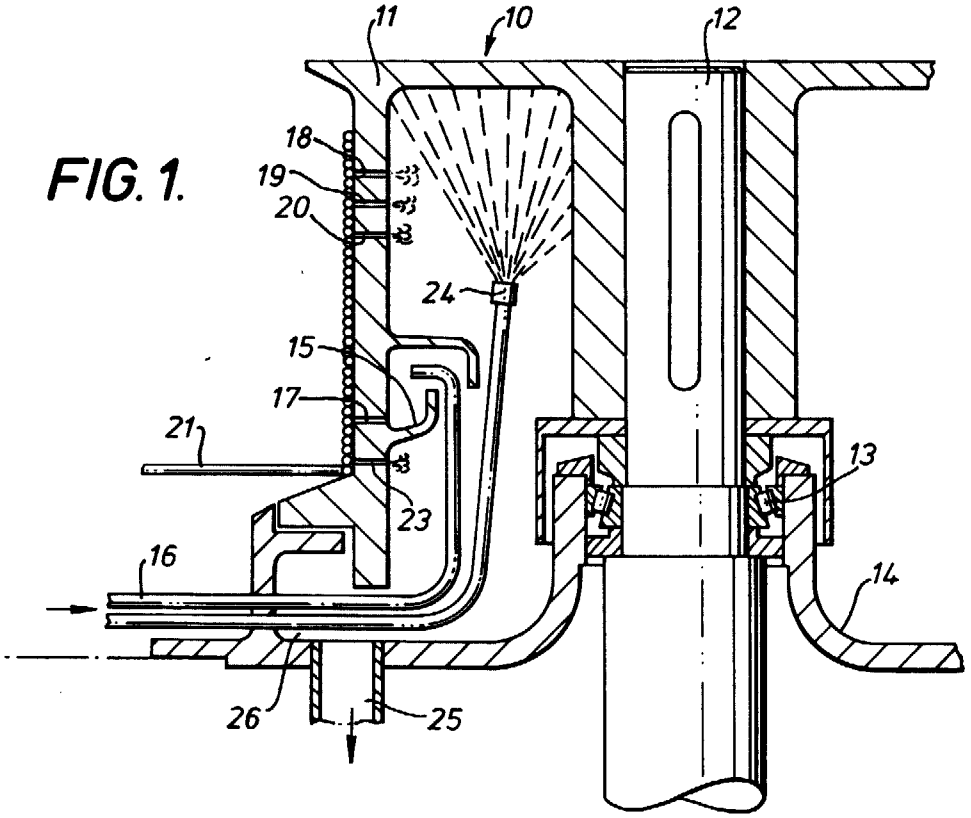
FIG. 1 is a longitudinal section through a capstan of a wire-drawing apparatus provided with means for cooling the wire according to the present invention and constituting a first embodiment.

FIG. 1 shows the capstan 10 of wire-drawing apparatus provided with a system for cooling the drawn wire in accordance with the method according to the present invention. The capstan 10 comprises a drum 11 mounted on a support shaft 12 which is rotatably mounted in a bearing 13 carried by support structure 14. The drum 11 is hollow and is provided on its internal surface with an annular trough 15 to which a liquid coolant such as water is supplied from a supply circuit 16. The drum 11 is provided with a ring of holes 17 which communicate with the interior of the trough 15. The number of holes 17 will depend upon the flow of liquid coolant required for carrying out effective cooling. Axially spaced from the ring of holes 17 are three rings of holes 18, 19 and 20. It will be appreciated that only one of the rings of holes 18, 19, 20 need be provided.

Figure 2:
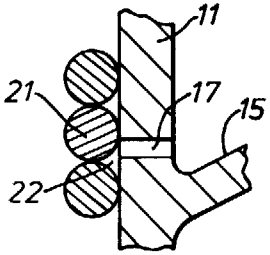
FIG. 2 is a view on an enlarged scale of part of the capstan shown in FIG. 1.

The wire 21 which has been drawn through a die or dies (not shown) of the wire-drawing apparatus is wound around the drum 11 with a plurality of turns. As is more clearly shown in FIG. 2 the adjacent turns of wire 21 form with the external surface of the drum 11 a helical space 22.

The shaft 12 is driven by a motor (not shown) so that the drawn wire 21 is wound onto and discharged from the drum 11. The liquid coolant in the trough 15 is forced to flow through the holes 17 due to the effect of centrifugal force applied thereto and flows into the space 22 where it is carried upwardly by the motion of the space 22 as the wire 21 is moved onto and discharged from the drum 11. Some liquid coolant may flow downwardly along the space 22 due to gravitational forces but the downward flow can only be helical and must travel one helix faster than the capstan revolution in order to reach the bottom of the space 22. Any downward flow of liquid coolant is evaporated and the evaporate can pass into the interior of the drum 11 through apertures 23.

Heat from the coils of wire 21 is transferred directly to the water in the helical space 22 and the wire 21 is cooled by utilizing the latent heat of evaporation of the liquid coolant. The wire temperature is sufficient to heat the liquid coolant above the evaporation point of the liquid and the evaporate will pass through the holes 18, 19, 20 into the interior of the drum 11.

A spray device 24 may be provided to spray water or other liquid within the drum 11 in order to condense the evaporate and drain water is removed by a drain conduit 25 connected to a collection sump 26 arranged below the drum 11.

The quantity of liquid coolant fed to the trough 15 is preferably metered in proportion with the power input to the apparatus so that all of the liquid coolant supplied to the space 22 is evaporated before being discharged through holes 18, 19, 20 and 23. Consequently the latent heat of evaporation of the liquid coolant is used in cooling the wire 21 thereby reducing the amount of liquid coolant required.

The apparatus for effecting cooling of the wire 21 does not increase the length of the wire-drawing machine and can be combined with an external cooling system if necessary.

Figure 3:
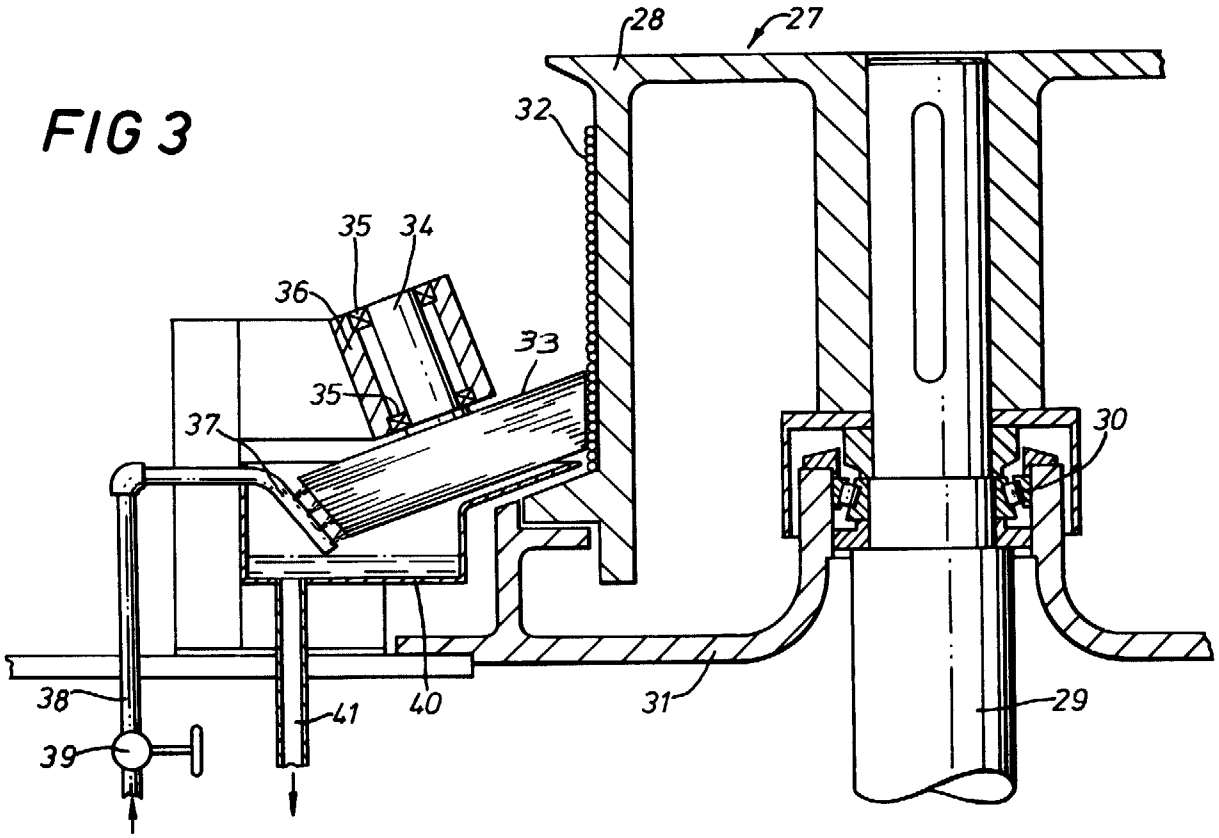
FIG. 3 is a longitudinal section through a capstan of a wire-drawing apparatus provided with a roller for applying liquid coolant to the turns of drawn wire wound on the capstan and constituting a second embodiment of the invention.

The capstan 27 shown in FIG. 3 comprises a drum 28 mounted on a support shaft 29 which is rotatably mounted in a bearing 30 carried by support structure 31. Wound on the drum 28 are a plurality of turns of drawn wire 32 which has been drawn through a die or dies (not shown) of the wire-drawing machine. The wire 32 moves up the drum 28.

Adjacent the drum 28 is a roller 33 having a shaft 34 mounted in bearings 35 carried in a housing 36. The housing 36 together with the roller 33 can be withdrawn or removed whilst the wire 32 is initially being threaded through the wire-drawing machine. The roller 33 has its periphery in contact with some of the turns of wire 32 on the drum 28 and is rotated by the wire 32 on the capstan 27.

. Liquid coolant, such as cold water, is sprayed onto the periphery of the roller 33 by a spray pipe 37 connected to a liquid coolant supply conduit 38 which contains a valve 39. The valve 39 is operated so that the quantity of liquid coolant which is fed to the spray pipe 37 is in phase with the power input to the wire-drawing machine. This ensures that all or substantially all of the liquid coolant applied by the roller 33 to the turns of wire 32 is evaporated and thus the latent heat of evaporation of the liquid coolant reduces the temperature of the wire 32. The flow of liquid coolant is thus kept to a minimum.

Located below the roller 33 is a sump 40 having a drain conduit 41. Excess liquid coolant and condensate are collected by the sump 40 and drained by the conduit 41.

It will be appreciated that a liquid coolant other than water can be used.

The cooling apparatus of FIG. 3 can be used alone or in conjunction with an indirect cooling system.

The cooling apparatus of FIG. 3 does not increase the length of the drawing machine and can be used with a variety of different sizes of capstan 27.

The supply of liquid coolant to the roller 33 can be effected in many different ways, for example the roller 33 may be arranged to pick up liquid coolant in a trough or tank.

The periphery of the roller 33 may be provided with a liquid absorbent material. The liquid coolant may be supplied to the periphery of the roller 33 through passages in the roller 33 which extend to the periphery thereof.

The roller 33 may be mounted so that it can be swung between an operative position and an inoperative position.

Figure 5:
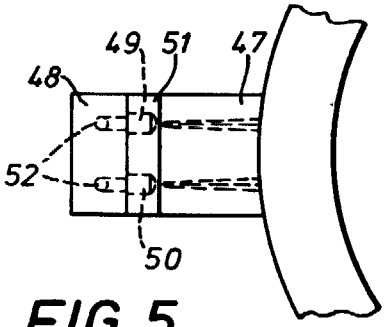
FIG. 5 is a plan view of the spraying means shown in FIG. 4.
Figure 4:
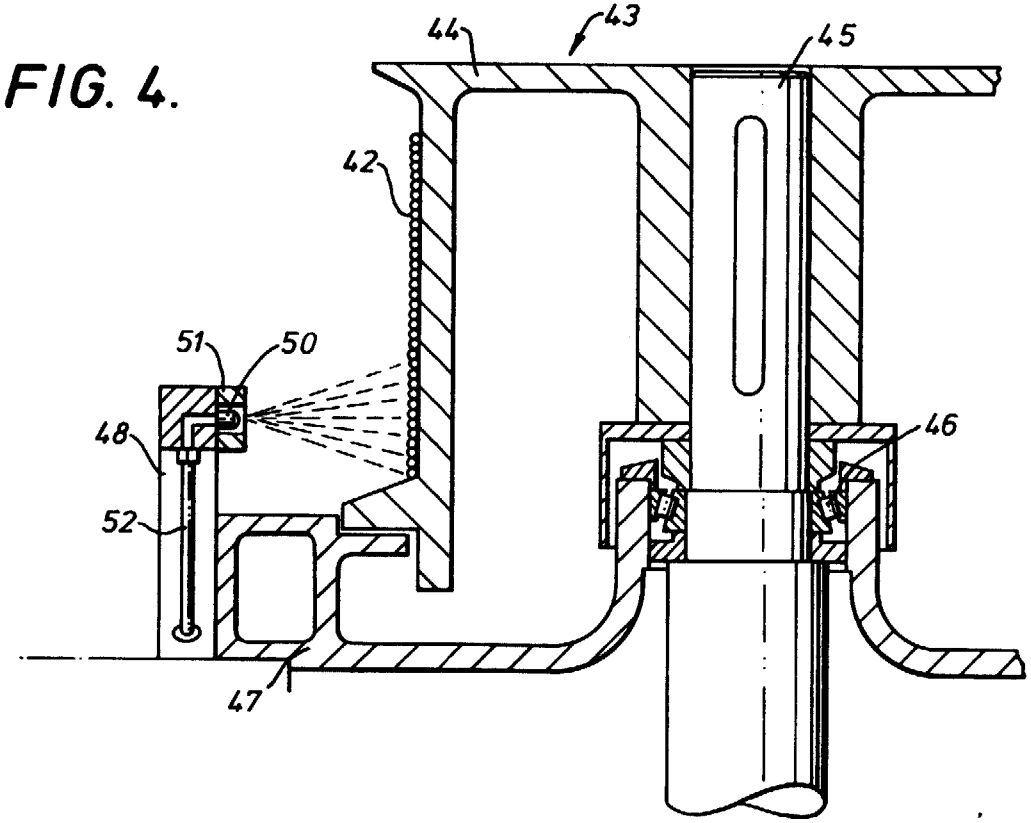
FIG. 4 is a longitudinal section through a capstan of a wire-drawing apparatus provided with spray nozzles for spraying liquid coolant onto the turns of drawn wire wound on the capstan and constituting a third embodiment of the invention.

FIGS. 4 and 5 show an embodiment in which the drawn wire 42 is wound on a capstan 43 which comprises a drum 44 mounted on a drive shaft 45 supported in a bearing 46 carried by structure 47. Fixed to the structure 47 is a bracket 48 provided with two atomizer spray nozzles 49 and 50 which spray liquid coolant, such as water, onto the turns of wire 42 wound on the capstan 43. The wire 42 is drawn onto the lower part of the drum 44 and moves up the drum. The spray nozzles 49 and 50 are protected from being damaged by any lashing wire by means of a housing 51. Liquid coolant under pressure is fed to the spray nozzles 49 and 50 by supply conduits 52. The liquid coolant which is sprayed onto the wire 42 is totally evaporated and the wire 42 is cooled by the latent heat of evaporation of the liquid coolant. Therefore the cooled wire 42 which leaves the capstan 43 is dry and preferably no wiping means are required.

Figure 7:
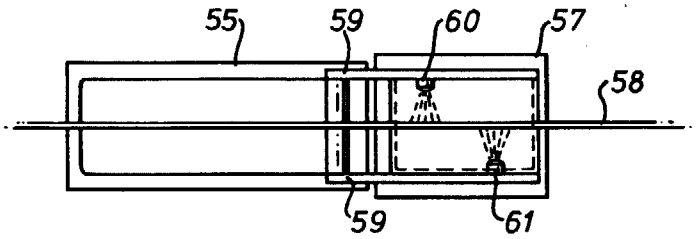
FIG. 7 is a plan view taken in the direction of arrow 7 shown in FIG. 6.
Figure 6:
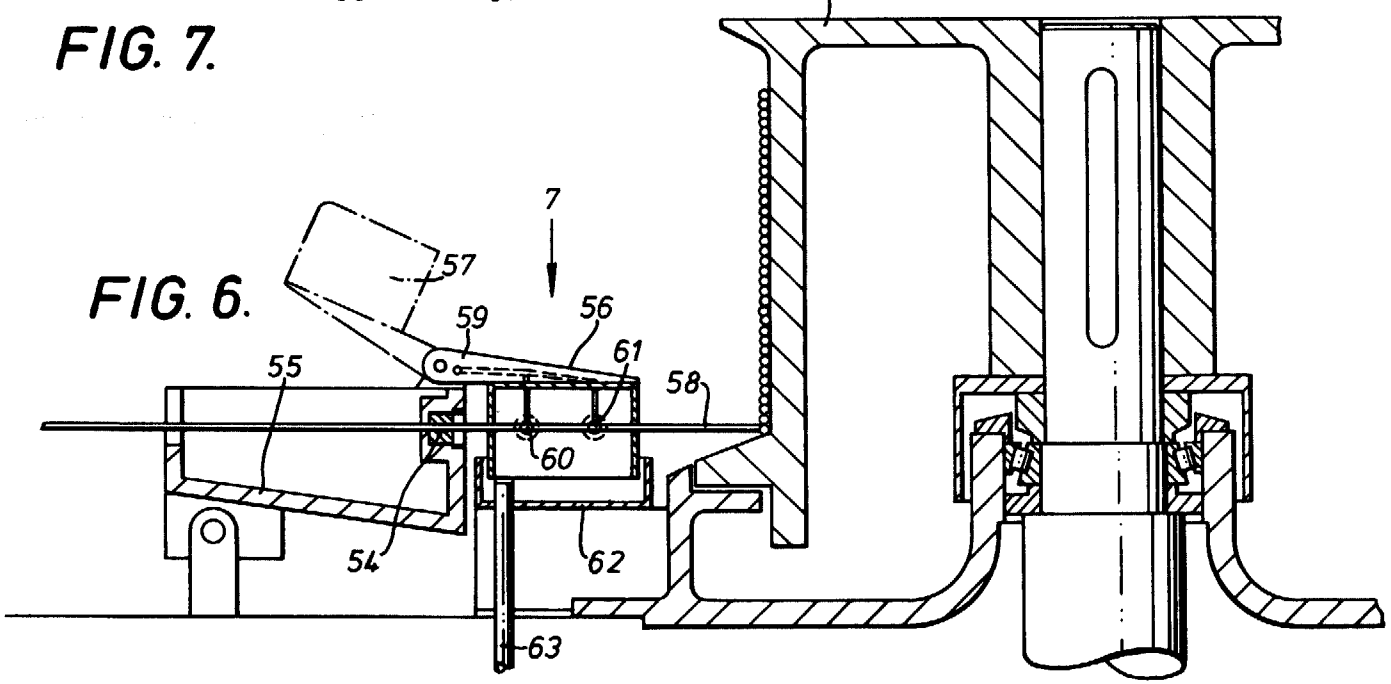
FIG. 6 is a longitudinal section through a wire-drawing apparatus provided with spray means between the die and the capstan and constituting a fourth embodiment of the invention.

FIGS. 6 and 7 show a wire-drawing apparatus which comprises a capstan 53, similar to the capstan 43 of FIG. 4, a die 54 which is mounted in a die-box 55 and a liquid coolant supply device 56. The device 56 consists of a box-like structure 57 open at its underside and having openings in opposed end walls through which wire 58 drawn through the die 54 by the capstan 53 can pass. The structure 57 is pivotably mounted by arms 59 to the die-box 55. Carried by the structure 57 are two atomizer spray nozzles 60 and 61 which spray liquid coolant, such as cold water, onto the drawn wire 58 in the region between the die 54 and the capstan 53. The structure 57 can be pivoted to the inoperative position shown in broken lines in FIG. 6 for the purpose of facilitating stringing-up of the wire in the wire drawing apparatus. Located below the structure 57, when in the operative position, in a sump 62 provided with a drain conduit 63. The quantity of liquid coolant which is applied to the wire 58 by the spray nozzles 60, 61 is completely evaporated and the latent heat of evaporation of the liquid coolant is used to cool the wire.

In the embodiments utilizing spray nozzles to spray liquid coolant onto the wire there may be two or more atomiser spray nozzles as described or a single duplex spray nozzle.

Figure 8:
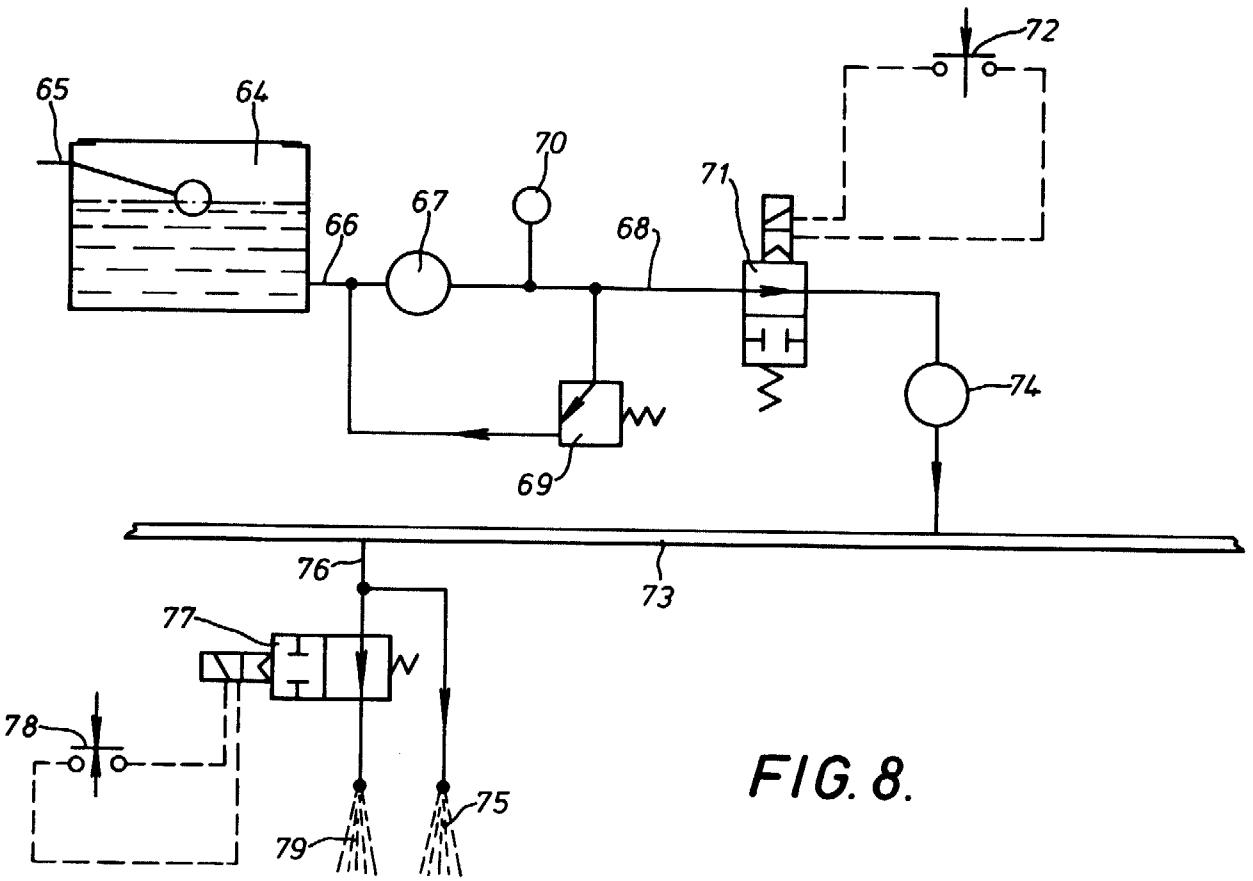
FIG. 8 is a diagram of the control system for controlling the flow of liquid coolant to spray nozzles.

FIG. 8 shows a suitable supply and control system for controlling the supply of liquid coolant supplied to the plurality of spray nozzles or a duplex spray nozzle. The system comprises a reservoir 64 for liquid coolant. Where the liquid coolant comprises cold water this may be taken from a pressurized supply source and the quantity contained in the reservoir 64 controlled by ball cock control 65. Connected to the reservoir 64 is a conduit 66 leading to the inlet of a pump 67 which supplies liquid coolant under pressure to a conduit 68. The pressure of the liquid coolant in the conduit 68 is regulated by a pressure relief valve 69 in parallel with the pump 67, the pressure being indicated on a pressure gauge 70. Provided in the conduit 68 is a solenoid operated control valve 71 which is controlled by a relay after a period of time determined by a timer 72. The period of time determined by the timer 72 can be adjusted to allow the wire sufficient time to be increased in temperature to that necessary to evaporate the liquid coolant applied thereto after the start button for the wire-drawing apparatus has been operated. The liquid coolant is then delivered at the regulated pressure to a main conduit or manifold 73 by way of a filter 74. The pressurized liquid coolant is supplied by the manifold 73 to the atomiser spray nozzle 75 via conduit 76 and is applied to the wire in an atomised form at a predetermined volume. The conduit 76 also leads via a solenoid operated control valve 77 which is controlled by a timer 78 to a spray nozzle 79. After the solenoid operated valve 71 has been opened the solenoid operated valve 77 which is controlled by the timer 78 is opened for a variable period and closed for a variable period determined by the timer 78 so that the pressurized liquid coolant supplied by spray nozzle 79 is used to supplement the volume sprayed onto the wire by the nozzle 75.

I claim:

1. Apparatus for cooling elongate material after it has been drawn through a die comprising:

spray means including at least two atomizer spray nozzles located downstream of the die at a predetermined spacing therefrom for supplying liquid coolant onto said elongate material, and means for controlling the quantity of said coolant supplied by said spray nozzles, the spaced relationship between said spray nozzles and said die being such as to allow the material to reach a desired temperature before the material reaches said first nozzle, which relationship in combination with the quantity of coolant controlled by said control means assures that all or substantially all of said sprayed liquid coolant applied to said elongate material is evaporized and the latent heat of evaporation of said liquid coolant serves to cool said elongate material.

2. Apparatus for cooling elongate material in accordance with claim 1, wherein said space relationship between said first spray nozzle and said die allows said desired temperature to be an increase in the temperature of the material after it leaves said die and before it reaches said first spray nozzle.

3. Apparatus for cooling elongate material after it has been drawn through a die comprising:

spray means including at least two atomizer spray nozzles located downstream of the die for supplying liquid coolant onto said elongate material, and means for controlling the quantity of said coolant supplied by said spray nozzles so that all or substantially all of said sprayed liquid coolant applied to said elongate material is evaporated and the latent heat of evaporation of said liquid coolant serves to cool said elongate material, said control means comprising:

means for delaying the initiation of the application of the coolant upon the material leaving the die until the material reaches a desired temperature.

4. Apparatus for cooling elongate material in accordance with claim 3 wherein said control means further includes:

a storage tank for said liquid coolant, a pump for pumping said liquid from said storage tank, a manifold, conduit means for transporting sad liquid coolant from said storage tank to said pump and said manifold and from said manifold to said spray nozzles, a first solenoid operated valve for controlling the flow of liquid from said pump to said manifold and from said manifold to said first atomizer spray, a second solenoid operated valve for controlling the flow of liquid from said manifold to said second atomizer spray nozzle, and wherein said means for delaying includes a first timer for controlling operation of said first solenoid operated valve, and a second timer for controlling operation of said second valve.

5. Apparatus for cooling elongate material in accordance with claim 3 wherein said control means further includes:

means for storing said liquid coolant, liquid coolant pressure developing means connected to said storage means, manifold means, conduit means for transporting said liquid coolant from said storage means to said pressure developing means and said manifold means and from said manifold means to said spray means, means for controlling the flow of said liquid from said pressure developing means to said manifold means, and wherein said means for delaying includes means for controlling operation of said flow control means.

* * * * *